US009719148B2

(12) United States Patent
Taira et al.

(10) Patent No.: US 9,719,148 B2
(45) Date of Patent: Aug. 1, 2017

(54) FURNACE, REFRACTORY INSTALLING METHOD, AND REFRACTORY BLOCK

(75) Inventors: Hatsuo Taira, Tokyo (JP); Taijiro Matsui, Tokyo (JP); Takayuki Uchida, Tokyo (JP); Shingo Umeda, Tokyo (JP); Hiroshi Imagawa, Tokyo (JP); Shintaro Kobayashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 475 days.

(21) Appl. No.: 13/261,016

(22) PCT Filed: May 19, 2010

(86) PCT No.: PCT/JP2010/003370

§ 371 (c)(1),
(2), (4) Date: Nov. 14, 2011

(87) PCT Pub. No.: WO2010/134333

PCT Pub. Date: Nov. 25, 2010

(65) Prior Publication Data

US 2012/0064473 A1 Mar. 15, 2012

(30) Foreign Application Priority Data

May 19, 2009 (JP) ..... 2009-120853

(51) Int. Cl.
*F27D 1/16* (2006.01)
*C21C 5/44* (2006.01)
(Continued)

(52) U.S. Cl.
CPC ..... *C21C 5/44* (2013.01); *C21B 7/06* (2013.01); *C21B 9/06* (2013.01); *F27D 1/1621* (2013.01); *Y10T 29/49623* (2015.01)

(58) Field of Classification Search
CPC ..... F27D 1/0023; F27D 1/0033; F27D 1/004; F27D 1/0045; F27D 1/10; F27D 1/145; F27D 1/147; F23M 5/02
(Continued)

(56) References Cited

U.S. PATENT DOCUMENTS 1,512,004 A * 10/1924 Stevens ..... F27D 1/025 110/335
1,582,275 A * 4/1926 Kellner ..... F23M 5/06 110/334
(Continued)

FOREIGN PATENT DOCUMENTS

CN 2893595 4/2007
EP 1715271 10/2006
(Continued)

OTHER PUBLICATIONS

International Search Report dated Aug. 17, 2010 issued in corresponding PCT Application No. PCT/JP2010/003370.
(Continued)

*Primary Examiner* — Alissa Tompkins
*Assistant Examiner* — Nathaniel Herzfeld
(74) *Attorney, Agent, or Firm* — Birch, Stewart, Kolasch & Birch, LLP

(57) ABSTRACT

The furnace of the present invention includes a body of a furnace having a cylindrical shape; a steel shell which is arranged at an inside surface of the furnace; and a lining refractory which is arranged at an inside of the steel shell and includes a plurality of refractory blocks, wherein: each of the refractory blocks includes a hot-face end surface which has a hexagonal shape exposed to a middle of the furnace, and a cold-face end surface which has a hexagonal shape larger than the hot-face end surface, the cold-face end surface being arranged at an outer periphery side of the
(Continued)

furnace; the refractory blocks are arranged such that each position of the hot-face end surface is positioned along the radial direction of the furnace at a predetermined reference position; and the refractory blocks are arrayed along the circumferential direction of an inside surface of the steel shell, thereby being stacked in a honeycomb manner.

1 Claim, 12 Drawing Sheets

(51) Int. Cl.
*C21B 7/06* (2006.01)
*C21B 9/06* (2006.01)

(58) Field of Classification Search
USPC ..... 432/251, 252, 119; 110/336, 338
See application file for complete search history.

(56) References Cited

U.S. PATENT DOCUMENTS 2,829,877 A * 4/1958 Davis, Jr. ..... F27B 7/28 110/336
3,246,442 A * 4/1966 Sauer ..... 52/747.13
3,280,772 A * 10/1966 Burklo ..... F27D 1/08 110/340
3,282,231 A * 11/1966 Walt ..... F27D 1/148 110/340
3,287,875 A * 11/1966 Lakin ..... 52/747.13
3,296,154 A * 1/1967 Ferrigno ..... 521/57
3,298,154 A * 1/1967 Behr ..... B66C 23/20 212/224
3,854,256 A 12/1974 Wilce
4,546,583 A * 10/1985 Hussar ..... 52/236.1
4,584,812 A * 4/1986 Miskolczi, Jr. ..... 52/749.15
4,827,689 A * 5/1989 Lonardi ..... F27D 1/1621 414/10
4,848,055 A * 7/1989 Wade ..... 52/506.02
5,033,959 A * 7/1991 Bernt et al. ..... 432/118
5,090,610 A * 2/1992 Bernt et al. ..... 228/138
5,427,360 A * 6/1995 Erny ..... B22D 41/02 266/275
5,926,933 A * 7/1999 Kaehr ..... 29/402.08

FOREIGN PATENT DOCUMENTS

| | | |
|---|---|---|
| EP | 1975258 | 10/2008 |
| GB | 2022229 | 12/1979 |
| GB | 2193564 | 2/1988 |
| JP | 59-145553 | 9/1984 |
| JP | 1-147013 | 6/1989 |
| JP | 01147013 A * | 6/1989 |
| JP | 3-67996 | 7/1991 |
| JP | 4-18643 | 2/1992 |
| JP | 7-292366 | 11/1995 |
| JP | 08-005262 | 1/1996 |
| JP | 2519918 | 9/1996 |
| JP | 10-298632 | 11/1998 |
| JP | 2005-009707 | 1/2005 |
| WO | WO 84/01996 | 5/1984 |

OTHER PUBLICATIONS

Chinese Search Report dated May 30, 2013 issued in corresponding Chinese Application No. 201080021566.2.
Korean Office Action dated Dec. 10, 2012, issued in corresponding Korean Application No. 10-2011-7027294, and an English translation thereof.
Search Report dated Mar. 3, 2014 issued in corresponding European Application No. 10777570.2.

* cited by examiner

FURNACE, REFRACTORY INSTALLING METHOD, AND REFRACTORY BLOCK

TECHNICAL FIELD

The present invention relates to a furnace such as a converter furnace, a blast furnace, or a ladle used for producing steel, a method for installing refractories, and refractory blocks.

This application is a national stage application of International Application No. PCT/JP2010/003370, filed May 19, 2010, which claims priority to Japanese Patent Application No. 2009-120853, filed May 19, 2009, the contents of which are incorporated herein by reference.

BACKGROUND ART

In refining furnaces such as a converter furnace for producing steel, a steel shell provided inside a furnace body is firstly applied with rectangular permanent bricks, which are a so-called "permanent lining", on the furnace bottom and the furnace wall. Then, an entire surface of the furnace bottom is paved with rectangular wear bricks by placing the wear bricks over the permanent bricks. After completing the lining of the wear bricks to the furnace bottom, other wear bricks are installed step-by-step along the furnace wall from a lower row of the furnace bottom to an upper row of the furnace wall by placing the wear bricks over the permanent bricks on the same plane. This is a basic process of furnace building.

For improving the efficiency of such a furnace building process, several methods have been proposed (for example, in Patent Document 1 and Patent Document 2).

Patent Document 1 is directed to a brick stacking device by which bricks supplied from a conveyance unit can be moved smoothly and promptly so as to be compacted at a predetermined position.

Patent Document 2 proposes a brick stacking method in which two kinds of bricks with different shapes are substantially circumferentially arranged in several rows in a predetermined order.

That is, in Patent Document 1 and Patent Document 2, each brick having a rectangular cross-sectional shape is compressed to a permanent brick surface for building a furnace.

RELATED ART DOCUMENTS

Patent Documents

Patent Document 1: Japanese Unexamined Patent Application, First Publication No. H8-5262

Patent Document 2: Japanese Unexamined Patent Application, First Publication No. 2005-9707

DISCLOSURE OF THE INVENTION

Problems to be Solved by the Invention

However, in the techniques disclosed in Patent Document 1 and Patent Document 2, the positions of the bricks in the circumferential direction need to be determined for each row, so that a long time is required for the furnace building. In addition, in a case of using rectangular bricks, each of the bricks is in a state of being supported by a constraining force from two adjacent bricks. Accordingly, there is a concern that if there is a portion where the constraining force from adjacent bricks is weak after building the furnace in the vertically standing state, the brick may drop, for example at the time of tilting the furnace fore and aft. If the brick drops, it is necessary to again set back the furnace to the standing state, remove the bricks one-by-one from the upper row, reline the dropped part to the original position, and compress each of the bricks again so as to build the furnace once again. Therefore, a long time is required for the furnace building.

In addition, in a case of using rectangular bricks, it is important to strongly compress the bricks to the permanent brick surface in order to prevent the rectangular bricks from dropping as mentioned above. However, in such a case, since the permanent bricks are compressed to the steel shell, there is a concern that the steel shell may be deformed. In addition, if the refractory blocks are arranged in a state such that the steel shell is deformed, there is a concern that a joint gap opening may occur.

An object of the present invention is to provide a furnace which can be built easily in a short time, a method for installing refractories, and refractory blocks.

Means for Solving the Problems

To achieve the above object, aspects of the present invention have the following features.

(1) A furnace according to an aspect of the present invention includes: a body of a furnace having a cylindrical shape; a steel shell which is arranged at an inside surface of the furnace; and a lining refractory which is arranged at an inside of the steel shell and includes a plurality of refractory blocks, wherein: each of the refractory blocks includes a hot-face end surface which has a hexagonal shape exposed to a middle of the furnace, and a cold-face end surface which has a hexagonal shape larger than the hot-face end surface, the cold-face end surface being arranged at an outer periphery side of the furnace; the refractory blocks are arranged such that each position of the hot-face end surface is positioned along a radial direction of the furnace at a predetermined reference position; and the refractory blocks are arrayed along the circumferential direction of an inside surface of the steel shell, thereby being stacked in a honeycomb manner.

(2) In the furnace according to (1), a space between the refractory blocks and the steel shell may be filled with monolithic refractories or powder refractories.

(3) In the furnace according to (1) or (2), the refractory blocks may be arranged with an intermediate of a thermal expansion absorbing member which absorbs a thermal expansion.

(4) In the furnace according to (1) or (2), the refractory block may further include a block arrangement jig having a metallic plate and a metallic grip that extends from a surface of the metallic plate, the block arrangement jig being fixed with an adhesive and a bolt.

(5) A refractory installing method according to an aspect of the present invention for installing refractories to an inside surface of a steel shell of a cylindrical furnace includes: using a refractory block which includes a hot-face end surface which has a hexagonal shape and a cold-face end surface which has a hexagonal shape larger than the hot-face end surface, and a half-block which has a shape obtained by dividing the refractory block at a plane that halves the hot-face end surface and the cold-face end surface respectively in two trapezoid shapes; arraying a plurality of the refractory blocks such that each position of the hot-face end surface is positioned along a radial direction of the furnace at a predetermined reference position, and stacking the refractory blocks along the circumferential direction in a honeycomb manner.

(6) In the refractory installing method according to (5), the refractory block may include a block arrangement jig having a metallic plate and a metallic grip that extends from a surface of the metallic plate, the block arrangement jig being fixed with an adhesive and a bolt, and the grip is grasped so as to lift and install the refractory block.

(7) A refractory block configured as a lining of an inside surface of a steel shell of a cylindrical furnace, according to an aspect of the present invention includes: a hot-face end surface which has a hexagonal shape; and a cold-face end surface which has a hexagonal shape larger than the hot-face end surface.

Effects of Invention

According to the present invention, in the construction of a furnace having a substantially cylindrical shape, refractory blocks each including a hot-face end surface with a hexagonal shape and a cold-face end surface with a hexagonal shape which is larger than the hot-face end surface are used. Therefore, even if the operation is performed by an unskilled lining operator, it is possible to determine the positions of the refractory blocks in the circumferential direction by only arranging refractory blocks in each row at predetermined intervals, and then fitting refractory blocks of a row currently being constructed between refractory blocks of a row under the row currently being constructed.

In a case of using conventional rectangular refractory blocks, adjacent refractory blocks are disposed so as to be in contact with each other in the vertical plane. Accordingly, a constraining force in the circumferential direction due to the weight of the refractory blocks cannot be generated. Therefore, the constraining force in the circumferential direction is determined based on the arrangement state (arrangement intervals), and thus, it is difficult to obtain a substantially constant constraining force.

On the other hand, in the present invention, since the refractory blocks are stacked in a honeycomb manner, the refractory blocks are disposed so as to be in contact with each other in a plane which is oblique to the vertical plane. Accordingly, a constraining force in the circumferential direction due to the weight of the refractory blocks can be generated, and thus a substantially constant constraining force can be obtained regardless of the arrangement state (arrangement intervals). As a result, it is possible to prevent the refractory blocks from dropping at the time of tilting a furnace. In addition, since the refractory blocks can be arranged based on the position of the hot-face end surface, there is no need to compress the refractory blocks to the permanent bricks. Accordingly, it is possible to prevent the deformation of the steel shell and the occurrence of the joint gap opening due to the deformation, whereby a furnace which can be constructed easily in a short time, an installing method, and a refractory block can be provided.

EMBODIMENTS OF THE INVENTION

Figure 1:
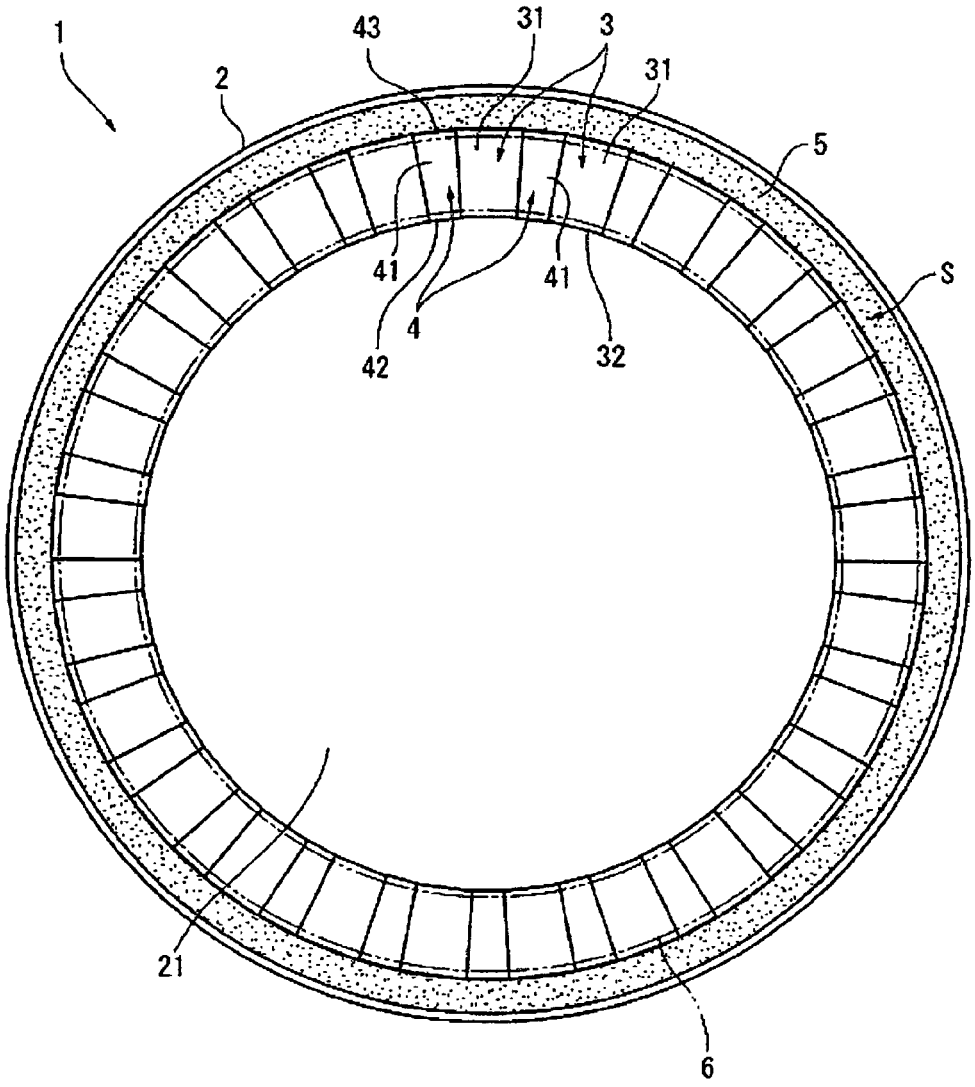
FIG. 1 is a plan view of a furnace according to an embodiment of the present invention.

In the present invention, as a refractory block used for lining the inside surface of a steel shell of a cylindrical furnace, for example, an unburned brick or a burned brick may be used. In a case of using the burned brick, a hexagonal refractory block can be obtained by producing a general rectangular brick and then machining it. In a case of using the unburned brick, a hexagonal refractory block can be obtained by producing a hexagonal formwork and then casting a monolithic refractory thereto, and further performing curing, drying, and heating processes. For the refractory block, it is possible to use a refractory block obtained by combining several blocks each having a trapezoid cross-sectional shape so as to form a hexagonal shape. In addition, the hot-face end surface (hereinafter, sometimes referred to as "inside") and the cold-face end surface (hereinafter, sometimes referred to as "outside") of the refractory block may be a planar surface, a circular surface, a curved surface, or the like. Moreover, in each end surface (hot-face and cold-face) of the refractory block, it is preferable that the angle of the vertex which extends in the circumferential direction be set to about 120°, more specifically, 115°-125°. If the angle is more than 125°, the constraining force in the circumferential direction is insufficiently exerted, and if the angle is less than 115°, the weight of the refractory blocks that acts on the portion including the vertex becomes large so that breakage may occur.

Note that a cylindrical furnace mentioned in the present invention does not necessarily have a perfect cylindrical shape, and may have a substantially cylindrical shape.

In the present invention, the refractory blocks are stacked in a honeycomb manner. Accordingly, even if some of the refractory blocks are defective (damaged), adjacent refractory blocks will not drop. Accordingly, there is no need to compress the refractory blocks to the steel shell side, and the refractory blocks can be arranged based on the position of the inside end surface thereof.

In a case of determining the position of the rectangular refractory block while compressing the rectangular refractory block to the permanent bricks arranged on the inside surface of the steel shell, that is, in a case of determining the position of the rectangular refractory block based on the outside end surface as in the related art, it is difficult for a lining operator who usually faces the inside end surface to check the outside end surface. Accordingly, the position may not be properly determined. In addition, in such a case, since the permanent bricks are compressed to the steel shell, there is a concern that the steel shell may be deformed. In addition, if the refractory blocks are arranged in a state such that the steel shell is deformed, there is a concern that the joint gap opening may occur.

On the other hand, if the refractory blocks are arranged based on the position of the inside end surface (hereinafter, referred to as "inside end dimensional basis"), it is easy for the lining operator to check the arrangement position and construct a furnace without damaging the steel shell.

In addition, in the present invention, it is preferable that a space between the refractory blocks and the steel shell be filled with monolithic refractories or powder refractories.

In a case of providing permanent bricks in the space between the refractory blocks and the steel shell, the heat in the furnace will conduct to the steel shell due to the radiation that passes through an air gap between the bricks, thereby increasing the temperature of the steel shell. Accordingly, the amount of heat diffused to the atmosphere from the furnace body will increase. In this case, it is necessary to consume extra energy for compensating the heat diffused to the atmosphere.

However, if the monolithic refractory or the powder refractory of magnesia is filled, it is possible to prevent the increase of the amount of the furnace body heat diffusion to the atmosphere, thereby accomplishing energy conservation. In addition, it is possible to prevent the steel shell from being deformed or the like due to the excessive heat so that a stable furnace can be provided.

Moreover, in the present invention, it is preferable to employ a configuration in which the refractory blocks are arranged with an intermediate of a thermal expansion absorbing member that absorbs the thermal expansion.

As the thermal expansion absorbing member, any member with shrinkability, for example, a sheet such as a corrugated board, a paper made from carbon fibers, or the like may be used. In addition, it is possible to employ a method in which the refractory blocks are arranged after an outer periphery of the each refractory block is covered with the thermal expansion absorbing member. Further, it is also possible to employ a method in which, after providing the thermal expansion absorbing member to an exposed surface of already arranged refractory blocks, other refractory blocks are arranged thereon.

According to the above configurations, since the thermal expansion absorbing member can absorb the heat generated at the time of operating the furnace, it is possible to reduce the stress acting on the refractory blocks and increase the service life of the refractory blocks.

The refractory installing method according to the present invention is a method for installing refractories to the inside surface of a steel shell of a cylindrical furnace. This method uses refractory blocks and half-blocks. The refractory block includes a hexagonal hot-face end surface which is exposed to the middle of the furnace and a hexagonal cold-face end surface which is larger than the hot-face end surface. The half-block is obtained by dividing the refractory block so that the hot-face end surface and the cold-face end surface are respectively halved to have a trapezoid cross-sectional shape. In this method, a plurality of the half-blocks each having the trapezoid cross-sectional shape in posture in which the length of the lower base is longer than the length of the upper base, is arranged such that the position of the half-block in the radial direction of the furnace is determined based on the hot-face end surface, and in this manner, a plurality of the half blocks are arrayed along the circumferential direction of the inside surface of the steel shell at predetermined intervals. Then, the refractory blocks are arrayed along the circumferential direction so as to be stacked in a honeycomb manner. Further, with respect to the top of the stacked refractory blocks, a plurality of the half-blocks each having the trapezoid cross-sectional shape in posture in which the length of the upper base is longer than the length of the lower base, are arrayed along the circumferential direction at predetermined intervals.

According to this configuration, a furnace can be constructed easily in short time. In addition, since the refractory blocks are arranged one-by-one after initially arranging the half-blocks, each of the blocks can be disposed in close contact with a flat bottom portion.

In addition, in the refractory installing method according to the present invention, it is preferable to prepare a block arrangement jig which has a metallic plate and a metallic grip extending from a surface of the metallic plate, attach the metallic plate of the block arrangement jig to the inside end surface of the refractory block or the inside end surface of the half-block with an adhesive, and fix them with a bolt, so that the refractory block and the half-block can be lifted and arranged while grasping the grip.

Here, if the block arrangement jig is fixed to the refractory block in a cantilever manner with only the adhesive, a sufficient fixing force may not be obtained. Further, if the block arrangement jig is fixed to the refractory block in a cantilever manner with only the bolt, a gap is generated between them so that a sufficient fixing force may not be obtained. In any of these cases, there is a concern that the refractory block may drop at the time of being conveyed. Accordingly, in the present invention, both the adhesive and the bolt are used for fixing the block arrangement jig to the refractory block so as to obtain a sufficient fixing force even if they are fixed in the cantilever manner. As a result, even if the grip is grasped by a lining device or the like, the refractory blocks can be installed without dropping, whereby the mechanizing of the furnace building is promoted and the working efficiency is improved. In addition, since the block arrangement jig is made of a metallic material, it is possible to melt the block arrangement jig at the time of preheating the furnace in the initial operation or operating the furnace. If the furnace is adapted to refine a metal, the melted jig can be used as a metallic source without an influence on the performance of the furnace.

The refractory block of the present invention, which is configured to be used as a lining of the inside surface of a steel shell of a cylindrical furnace, includes a hexagonal hot-face end surface which is exposed to the middle of the furnace, and a hexagonal cold-face end surface which is larger than the hot-face end surface.

By using the refractory block of the present invention, the furnace can be constructed easily in a short time.

Hereinafter, an embodiment of the present invention will be explained with reference to the attached drawings.

[Entire Configuration of a Furnace]

FIG. 1 illustrates a plan view of a furnace 1. The furnace 1 has a cylindrical steel shell 2 in which a lower surface is covered by a furnace bottom 21.

In the steel shell 2, half-blocks 3 and honeycomb blocks 4, which are refractory blocks, are installed. In FIG. 1, which includes large and small trapezoids which are arranged to form a ring shape, though not all of the half-blocks 3 and the honeycomb blocks 4 are assigned with the reference number, the large trapezoids indicate half-blocks 3 and the small trapezoids indicate honeycomb blocks 4. The half-blocks 3 and the honeycomb blocks 4 are made of refractories and have the same composition. The half-blocks 3 are arranged along the circumferential direction at predetermined intervals at the bottom and the top of the steel shell 2. At the time of arranging the honeycomb blocks 4, the position of the each honeycomb block 4 in the radius direction of the furnace 1 is determined based on the position of the inside end surface 32, 42, which is the hot-face end surface. In addition, each of the honeycomb blocks 4 is arrayed along the circumferential direction so as to be stacked in a honeycomb manner. That is, the honeycomb blocks 4 are arranged such that the circumferential position of a specific honeycomb block 4 in a specific row and the circumferential position of another honeycomb block 4 adjacent to the specific honeycomb block 4 in a row above or lower than the specific row are laterally shifted by a half-width of the honeycomb block 4.

Meanwhile, between the steel shell 2 and the half-block 3 or the honeycomb block 4, there exists a space S with a distance of approximately 230 mm. This space S is filled with, for example, magnesia powder having a particle diameter of 1-5 mm, as a powder refractory 5. In addition, the outer periphery 31 of the half-block 3 and the outer periphery 41 of the honeycomb block 4 are applied with paper material 6 of 2 mm in thickness as a thermal expansion absorbing member.

[Configuration of a Honeycomb Block]

Figure 2:
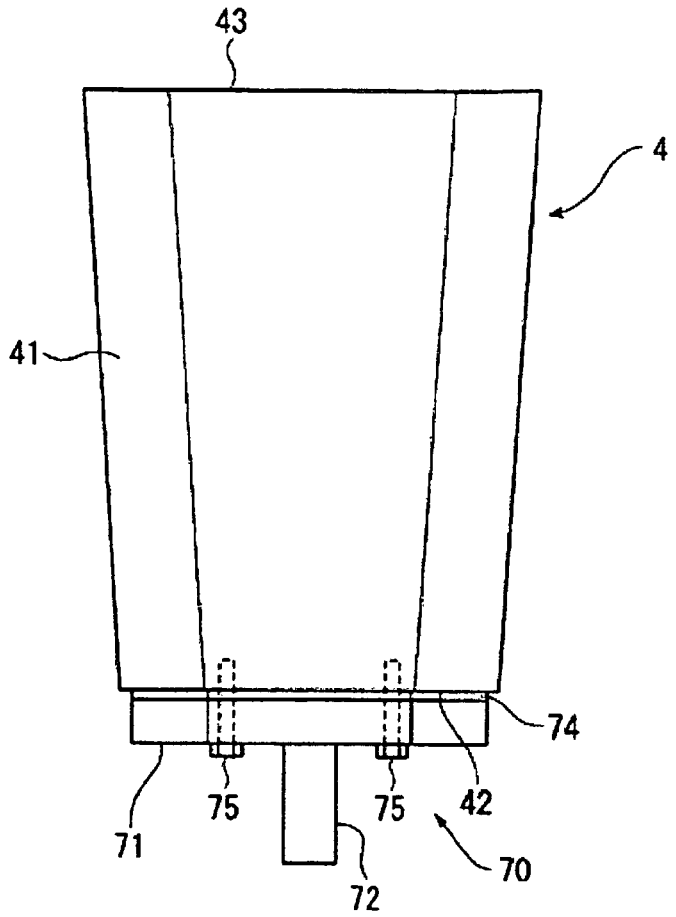
FIG. 2 is a plan view of a honeycomb block in the embodiment.
Figure 3:
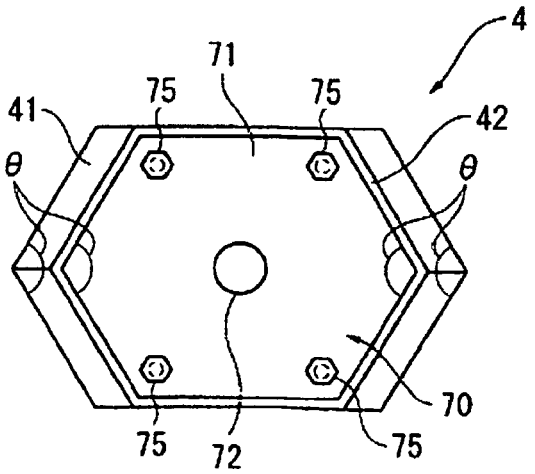
FIG. 3 is a view illustrating the honeycomb block in the embodiment when viewed from the inside end surface side.

As illustrated in FIG. 2 and FIG. 3, the honeycomb block 4 has an outer periphery 41, a hexagonal inside end surface 42 which is exposed to the inside surface of the lining of the furnace 1, and a hexagonal outside end surface 43 as a cold-face end surface which is larger than the inside end surface 42. The size of the honeycomb block 4 in height, width, and depth is suitably determined based on the size of the furnace 1 in width and height, the number of the honeycomb blocks 4 installed in the circumferential direction or the height direction, or the like. In addition, in the inside end surface 42 and the outside end surface 43, the angle θ of the vertex which extends in the lateral direction is preferably 115°-125°, and more preferably, 120°.

Moreover, at the time of installing the refractory blocks to the furnace 1, an iron-made honeycomb block arrangement jig 70 is fixed to the inside end surface 42 of the honeycomb block 4. This honeycomb block arrangement jig 70 includes a metallic plate which is smaller than the inside end surface 42, for example, an iron plate 71 with 5 mm thickness, and a grip 72 which has a straight round bar shape of 50 mm in diameter and extends from a substantially center portion of the surface of the iron plate 71. Then, the honeycomb block arrangement jig 70 is fixed to the honeycomb block 4 in a cantilever manner, by attaching the iron plate 71 to the inside end surface 42 with a phenol resin adhesive 74 with Al—Mg alloy in 5 mass %, and fixing them together with four bolts 75. Note that the size of the iron plate 71 may be the same as that of the inside end surface 42, but taking the workability and the fact that the inside end surfaces 42 of the adjacent honeycomb blocks 4 are in close contact with each other at the time of the lining operation into the consideration, it is preferable that the size of the iron plate 71 be smaller than the inside end surface 42, as illustrated in FIG. 2 and FIG. 3.

[Refractory Installing Method]

Figure 4:
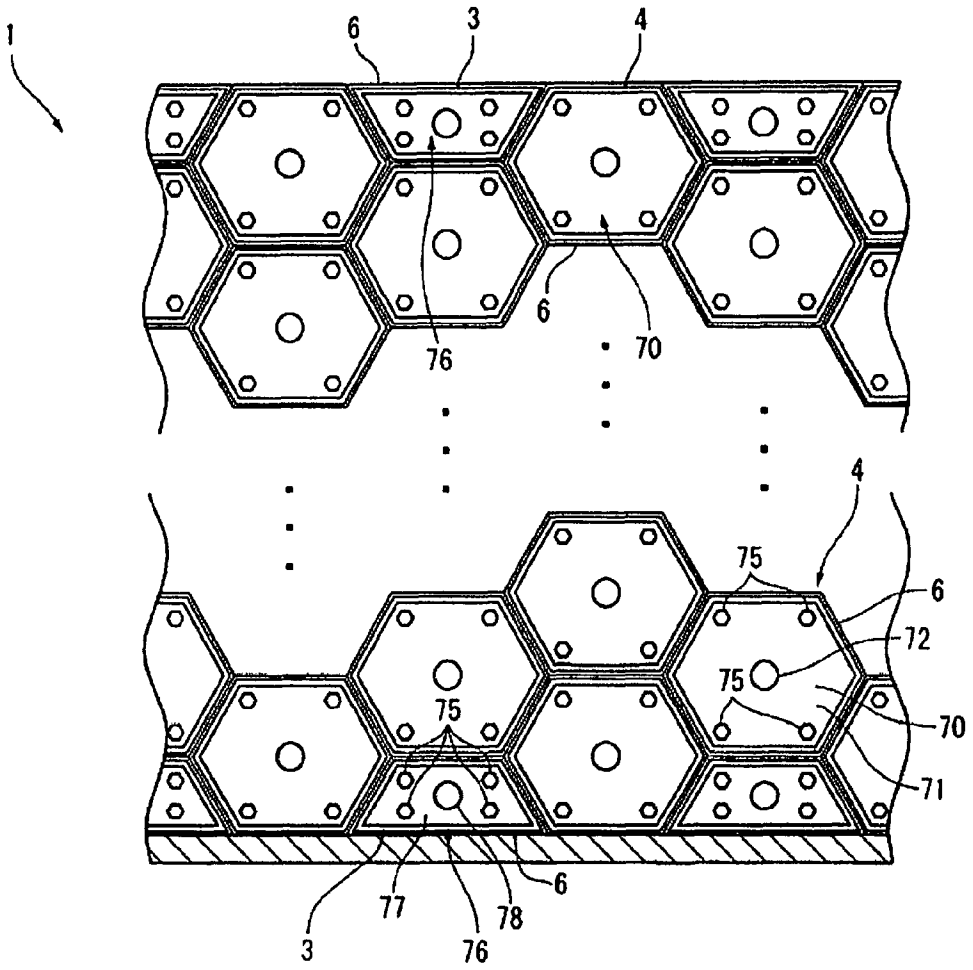
FIG. 4 is a view illustrating an arrangement of half-blocks and honeycomb blocks in the embodiment, when viewed from the inside of the furnace.

Firstly, for installing refractories to a furnace 1, half-blocks 3 each provided with a paper material 6 as a thermal expansion absorbing member and a half-block arrangement jig 76 as illustrated in FIG. 4, and honeycomb blocks 4 each provided with a paper material 6 as a thermal expansion absorbing member and a honeycomb block arrangement jig 70, are prepared. The half-block arrangement jig 76 includes a trapezoid iron plate 77 and a grip 78. The iron plate 77 is fixed to the inside end surface 32 (see FIG. 1) in a cantilever manner with an adhesive (not shown in the drawings) and a bolt 75.

Next, a lining device (not shown in the drawings) grasps the grip 78 and arranges the half-blocks 3 at a furnace bottom 21 of a steel shell 2 at predetermined intervals, as shown in FIG. 4. In this step, the half-blocks 3 are arranged based on the inside end dimensional basis. That is, each of the half-blocks 3 is arranged such that the inside end surface 32 of the half-block 3 is positioned at a predetermined reference position. This makes it possible to reliably generate a space S between the half-blocks 3 and the steel shell 2, whereby the interference between the both members can be reliably prevented.

Figure 5:
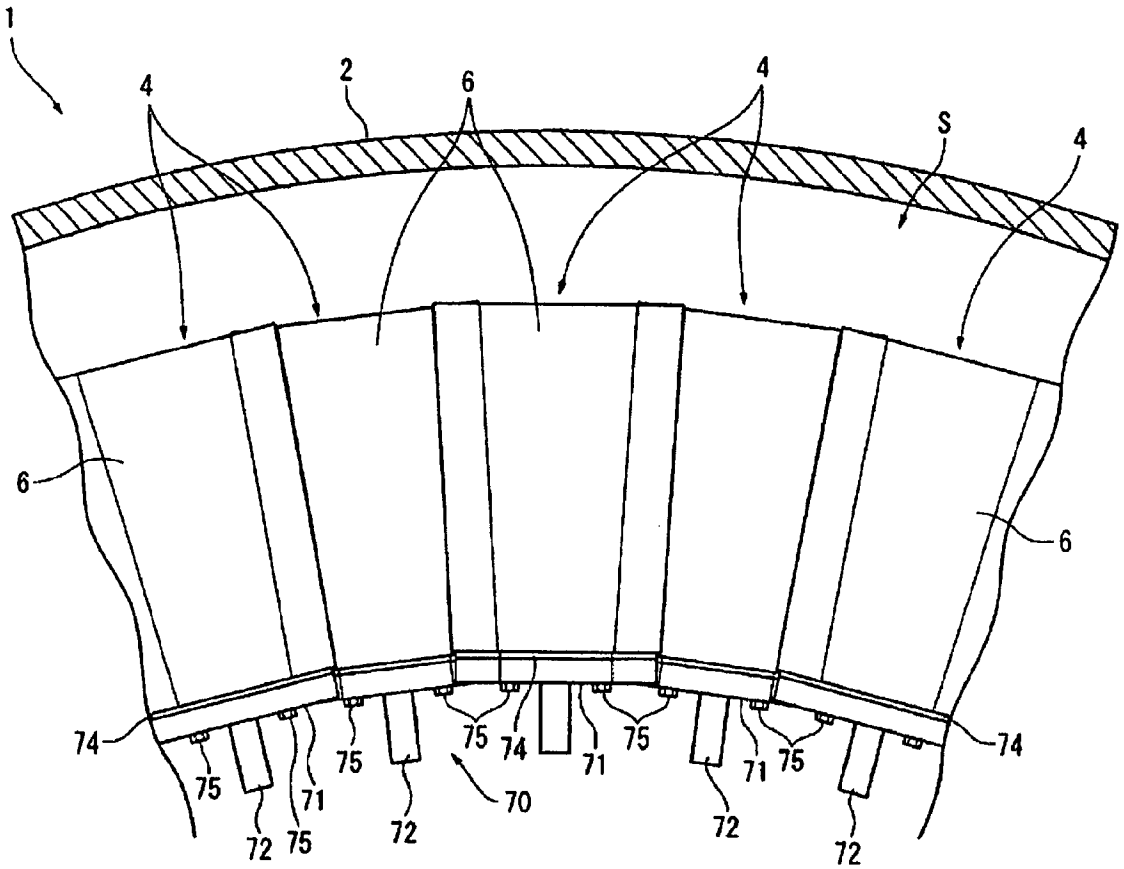
FIG. 5 is a plan view showing a state where honeycomb blocks in the embodiment are arranged.

Subsequently, the lining device grasps the grip 72 and arranges the honeycomb blocks 4 between the half-blocks 3 based on the inside end dimensional basis. In this step, without a particular position determining operation, the position of the honeycomb block 4 in the circumferential direction can be properly determined by merely fitting the honeycomb block 4 between the half-blocks 3. Then, as illustrated in FIG. 5, the honeycomb blocks 4 are arranged in a honeycomb manner based on the inside end dimensional basis in the circumferential direction and in the perpendicular direction.

Further, after arranging the honeycomb blocks 4 in the top row, half-blocks 3 in an upside down posture with respect to the posture of the half-blocks which have been arranged on the furnace bottom are arranged between the honeycomb blocks 4, thereby flattening the top surface. Then, the space S is filled with a powder refractory 5, thereby completing the furnace building of the furnace 1.

At the time the furnace building is completed, the honeycomb block arrangement jigs 70 and the half-block arrangement jigs 76 still remain in the furnace 1, but it is possible to melt these jigs at the time of preheating the furnace 1 in the initial operation or operating the furnace 1 without an influence on the performance of the furnace.

As a result of practically building a furnace 1 by employing the above-explained installing method, it was confirmed that the furnace building was achieved in approximately 1/10 of the construction time as compared with a case where conventional rectangular bricks are used.

In addition, after operating the furnace 1 through approximately 4000 charges (cycles), it was confirmed that none of the honeycomb blocks 4 dropped.

If the lining (installing) of the honeycomb blocks is performed by using the mechanical device as explained above, it is possible to use heavier honeycomb blocks (it is possible to use 500 kg/piece) as compared to a case where the lining of the honeycomb blocks is manually performed. Accordingly, it is possible to extend the size of the honeycomb block and automate the lining operation, thereby improving the efficiency of the lining operation. Further, if the weight per unit of the refractory is not less than approximately 500 kg/piece, the number of joint gaps between the refractories is reduced to 1/10 or less when compared with the related art, thus, the mechanical lining is desirable.

Figure 6:
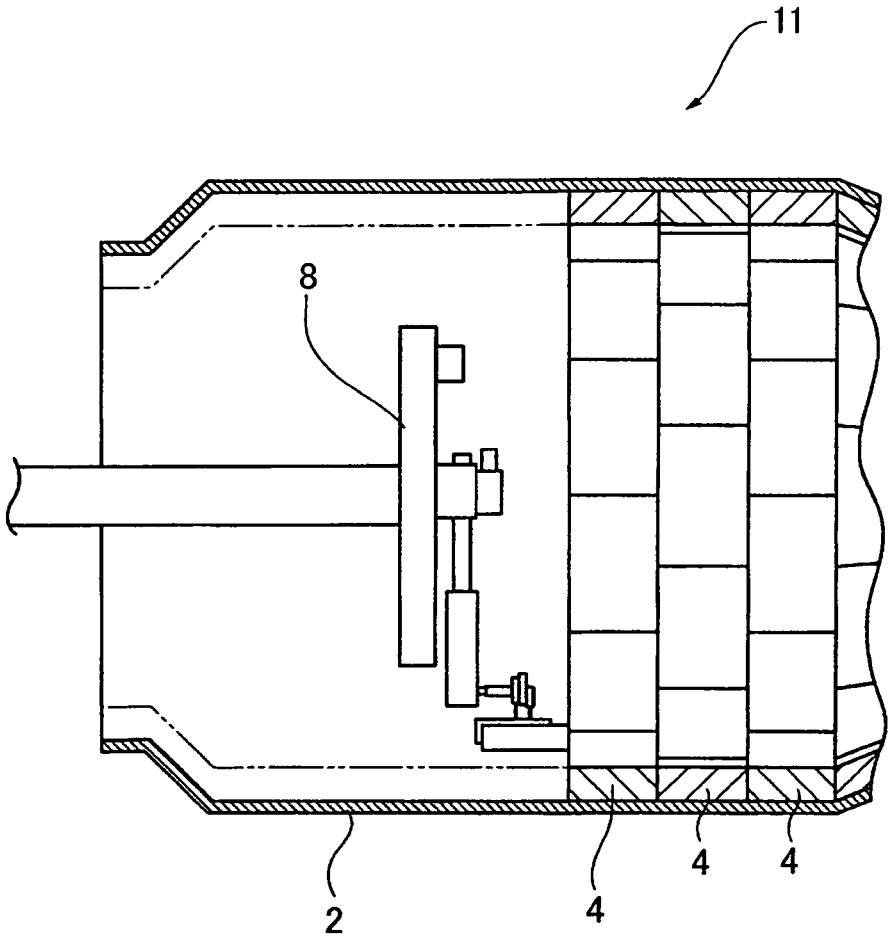
FIG. 6 is a view schematically illustrating a state where a refractory lining device used in an embodiment of the present invention is inserted into a converter furnace.
Figure 7:
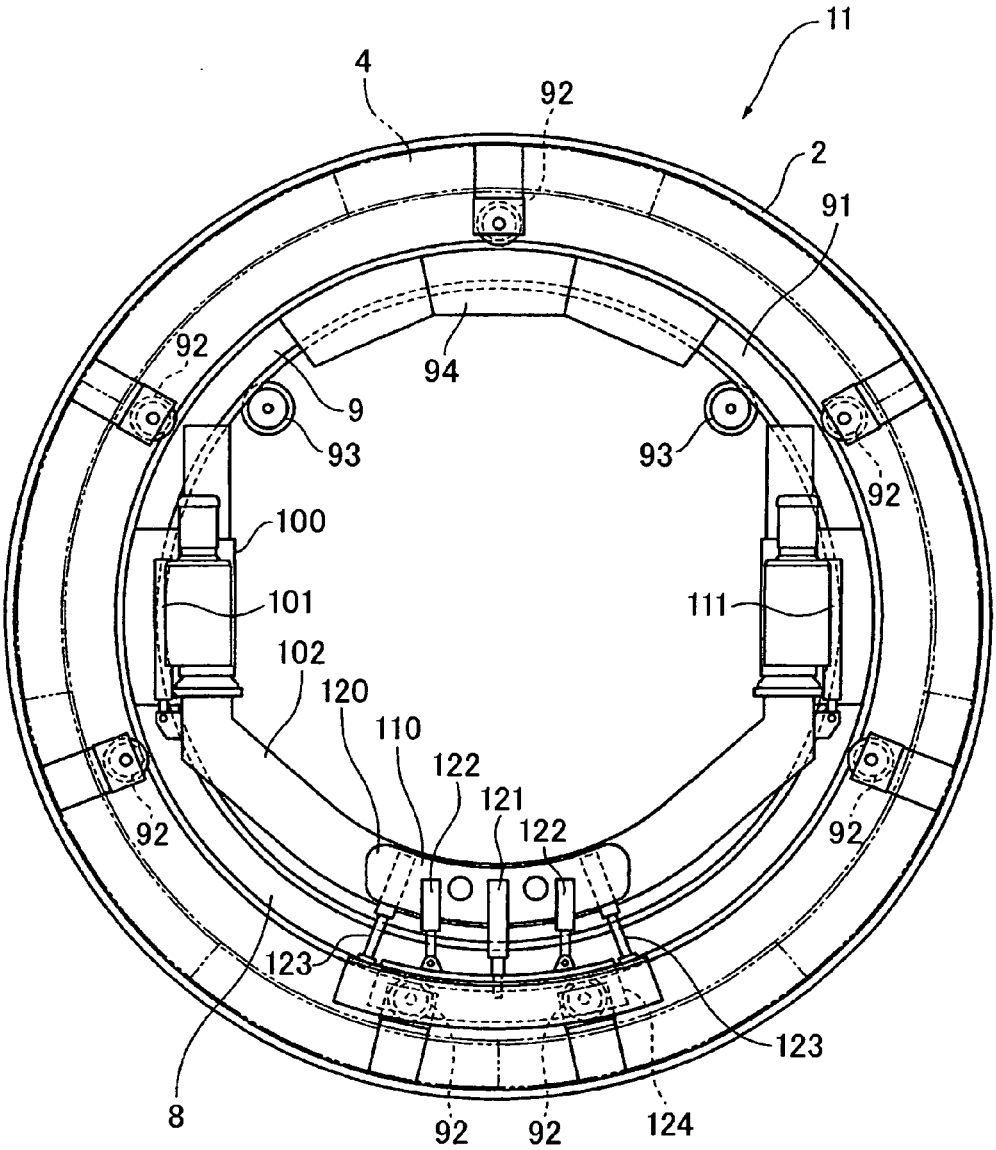
FIG. 7 is a front view illustrating a structure of the refractory lining device used in the embodiment.
Figure 8:
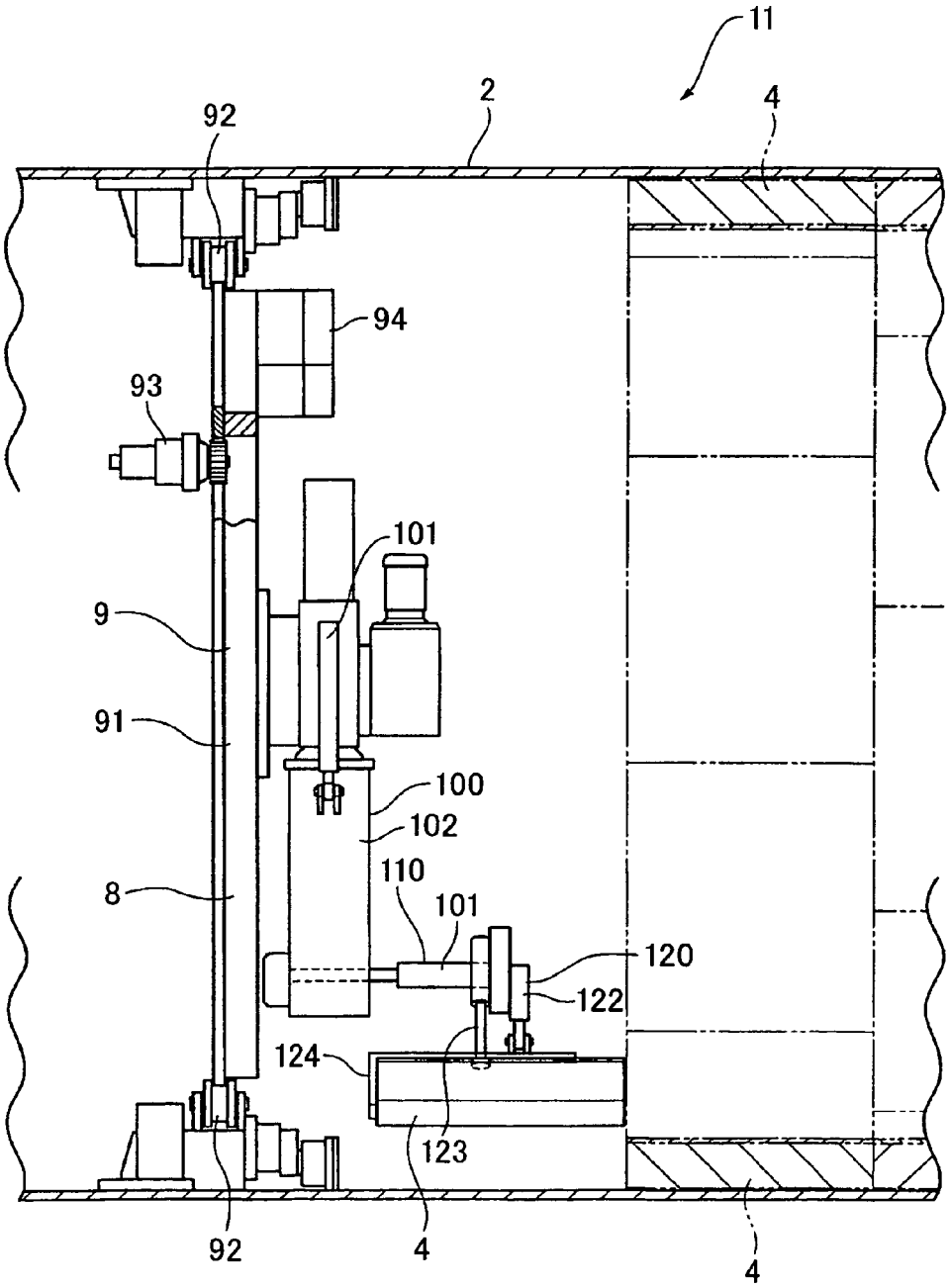
FIG. 8 is a side view illustrating a structure of the refractory lining device used in the embodiment.

Furthermore, as another embodiment of the refractory block (honeycomb block) lining device in the present invention, a device as illustrated in FIGS. 6-8 may be used. In a case of employing this device, the refractory block is provided with a female screw portion at the inside end thereof, instead of the grip 72 which is illustrated in FIG. 3.

The lining device illustrated in the drawings includes a refractory block holding mechanism, an axially moving mechanism, a radially moving mechanism, and a rotating mechanism.

The refractory block holding mechanism that holds a refractory block is provided with a male screw portion at the tip end thereof. Then, upon screwing the male screw portion with the female screw portion formed in the inside end surface of the refractory block, it is possible to hold the refractory block and move it in the vertical direction by means of a manual type actuator or a hydraulic type actuator.

In addition, this refractory block holding mechanism may also have a mechanism that can adjust the posture of the refractory block at the time of installing the refractory block.

The axially moving mechanism is a mechanism for moving the refractory held by the refractory block holding mechanism along the cylindrical axial direction of the refining container, and a hydraulic type actuator may be employed.

The radially moving mechanism is a mechanism for moving the refractory block held by the refractory block holding mechanism in the radial direction of the refining container, and a hydraulic actuator may be employed.

The rotating mechanism is a mechanism for moving the refractory block held by the refractory block holding mechanism along the circumferential direction of the inside end surface of the refining container, and for example, a configuration including a ring-shaped frame in which an inner gear is formed and a rotating motor provided with a pinion gear that engages with the ring-shaped frame at the rotating shaft may be employed.

Hereinafter, an embodiment in which the lining device is used is explained with reference to the attached drawings.

FIG. 6 illustrates a state where the honeycomb shaped refractory blocks 4 are installed as refractories to the inside surface of a steel shell 2 of a converter furnace 11 which is a furnace according to an embodiment of the present invention.

In this embodiment, using a front furnace space of the converter furnace 11 and a tilting function of the converter furnace 11, the honeycomb blocks 4 are installed in a state where the converter furnace 11 is tilted to the furnace front side, in view of the installability. Note that the furnace building device according to the present invention may be used from the upper opening portion of the converter furnace 11 in a vertically standing state, as conventionally performed.

The lining of the honeycomb blocks 4 is performed by a refractory block lining device 8 which enters into the convertor furnace 1 in a state where the openable bottom portion of the converter furnace 1 is open. Note that the refining container for which the refractory block lining device 8 can perform the lining operation is not limited to the converter furnace 11, and any type of refining container having a substantially cylindrical shape, such as a ladle, may be used.

FIG. 7 and FIG. 8 illustrate a specific structure of the refractory block lining device 8. FIG. 7 is an elevation view of the refractory block lining device 8 which is viewed from the axial direction of the cylindrical cylinder of the converter furnace 11, and FIG. 8 is a side view of the refractory block lining device 8.

The refractory block lining device 8 is installed inside the converter furnace 11, and moves rotationally, axially, and radially while holding a honeycomb block 4, thereby performing the lining operation on the inside surface of the steel shell 2 of the converter furnace 11. As shown in FIG. 7 and FIG. 8, the refractory block lining device 8 includes a rotating mechanism 9, a radially moving mechanism 100, an axially moving mechanism 110, and a refractory holding mechanism 120.

The rotating mechanism 9 is a mechanism for moving the honeycomb block 4 in the inside surface circumferential direction of the converter furnace 11 with respect to a cylindrical center axis of the converter furnace 11 which has a substantially cylindrical shape, and includes a ring frame 91, supporting rollers 92, a rotating motor 93, and a counterweight 94.

The ring frame 91 is a ring-shaped steel frame, and the inner circumferential surface of the ring is formed with an inner gear.

The supporting rollers 92 are multiply anchored to the inside surface of the steel shell 2 of the converter furnace 11 so as to rotatably support the ring frame 91 in the converter furnace 11.

The rotating motor 93 is a hydraulic driving device that rotates the ring frame 91. The rotating motor 93 has a driving shaft which is provided with a gear, and this gear engages with the inner gear of the ring frame 91, whereby the ring frame 91 rotates with respect to the cylindrical center axis of the converter furnace 11 as the rotating motor 93 is driven.

The counterweight 94 is arranged at the side substantially opposite to the refractory block holding mechanism 120 with respect to the center of the rotation of the ring frame 91, and functions as a weight balance when the refractory block holding mechanism 120 holds the honeycomb block 4.

The radially moving mechanism 100 is a mechanism for moving the honeycomb block 4 held by the refractory block holding mechanism 120 in the cylindrical radial direction of the converter furnace 11. The radially moving mechanism 100 is provided on the rotating mechanism 9, and includes a hydraulic cylinder 101 and a supporting arm 102.

Two of the hydraulic cylinders 101 are arranged on the ring frame 91 of the rotating mechanism 9 at diameter directional positions opposite to each other with respect to the center of the rotation of the ring frame 91.

The supporting arm 102 includes a pair of slidable sections which are arranged substantially in parallel, and an arm section which couples each end of the pair of the slide sections in a substantially half-circle form and which is provided with the axially moving mechanism 11. When the two hydraulic cylinders 101 slide the slidable sections, the supporting arm 102 is slid in the cylindrical radius direction of the converter furnace 11. Note that the form of the supporting arm 102 is not limited to the above, and an asymmetric cantilever type form or a link type form may be employed.

The axially moving mechanism 110 is a mechanism for moving the honeycomb block 4 held by the refractory block holding mechanism 120 to the cylindrical axial direction of the converter furnace 11. The axially moving mechanism 110 is arranged at a tip end of the supporting arm 102 of the radially moving mechanism 100 in the cylindrical radial direction, and is configured by a hydraulic cylinder 101.

The refractory block holding mechanism 120 is a mechanism for holding the honeycomb block 4, and is arranged at a tip end of the axially moving mechanism 110 in the cylindrical axial direction of the converter furnace 11. The refractory block holding mechanism 120 includes a center pin 121, a rolling jack 122, a holding cylinder 123, and a holding plate 124.

The center pin 121, which is attached to the substantially center portion of the honeycomb block 3 with a screw or the like, is a part for supporting the weight of the honeycomb block 3. The center pin 121 has a tip end to which a male screw portion is provided via a rotatable joint such as a universal joint.

The rolling jack 122 is a section for precisely adjusting the posture of the honeycomb block 4 by pushing and pulling the honeycomb block 4 from the back at the time of installing the honeycomb block 4, and is configured by a manual hydraulic cylinder.

The holding cylinder 123 is a section for holding an end portion of the honeycomb block 4, and likewise the center pin 121, the holding cylinder 123 has a tip end to which a male screw portion is provided via a rotatable joint such as a universal joint.

The holding plate 124 (metallic plates 71, 77 are flat plates) is a plate having an L-shaped side view, which vertically supports the weight of the honeycomb block 4.

In the rotating mechanism 9, the radially moving mechanism 100, the axially moving mechanism 110, and the refractory block holding mechanism 120 mentioned above, various type hydraulic actuators, hydraulic motors, and the like are used. Each performance of these driving sources needs to be determined based on the holding force, torque, rotating rate, radially moving velocity, and the force and the velocity with respect to the axially moving distance.

The holding force of the refractory block holding mechanism 120 may be a force that can lift up the honeycomb block 4 being held and push it to the outside, and also can adjust the position of the installed honeycomb block 4, at the time of constructing the honeycomb blocks 4.

Next, steps for installing the honeycomb blocks 4 by the above-mentioned refractory lining device 8 are explained with reference to FIGS. 9-14.

Firstly, for transporting honeycomb blocks 4 to an inside-furnace area in the convertor furnace 11, honeycomb blocks 4 which have been temporarily placed in a stock yard of the honeycomb blocks 4 are conveyed to the inside-furnace area by a conveying carriage of a battery locomotive in an expansive tube.

Next, the honeycomb blocks 4 conveyed to a honeycomb block setting position are charged in a honeycomb block supply device by a crane in the expansive tube, and are transferred to a place where the refractory lining device 8 can hold them.

Figure 9:
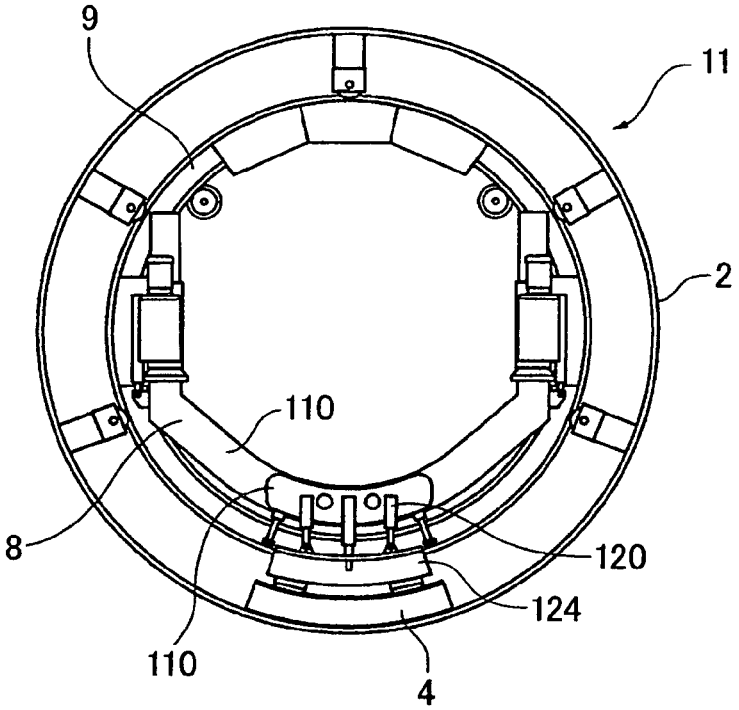
FIG. 9 is a view for schematically explaining a process of the refractory installing method in the embodiment.
Figure 10:
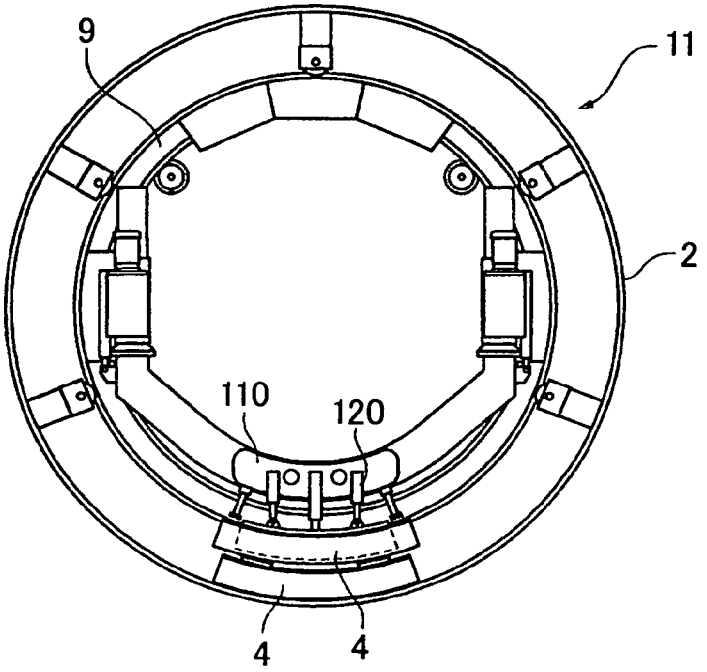
FIG. 10 is a view for schematically explaining a process of the refractory installing method in the embodiment.

After placing the honeycomb block 4 at the inside-furnace area, a honeycomb block 4 to be installed is arranged on the already installed honeycomb blocks 4, and then, the male screw portions of the center pin 121 and the holding cylinder 123 (the reference number is omitted in FIGS. 9-13) of the refractory holding mechanism 120 are inserted into holes formed in a coupling plate of the honeycomb block 4, and are fastened with nuts, so as to hold the honeycomb block 4 to be installed as illustrated in FIG. 9.

Figure 11:
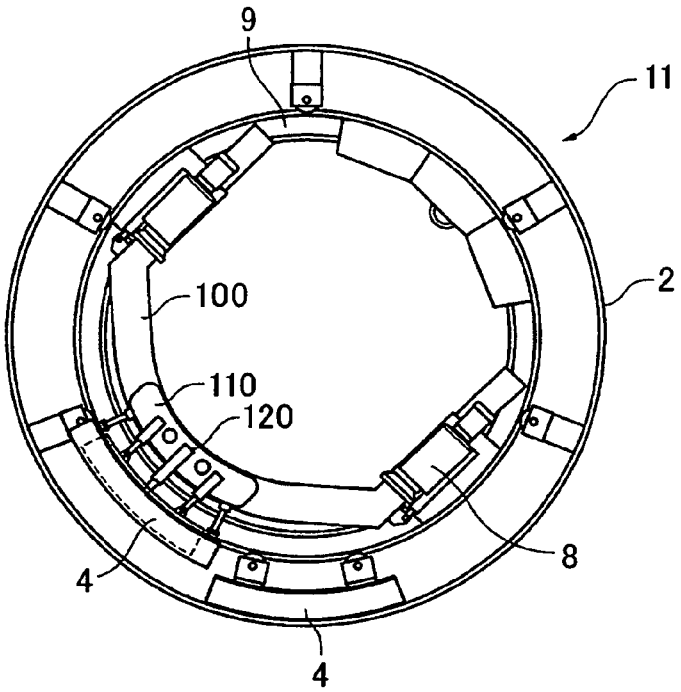
FIG. 11 is a view for schematically explaining a process of the refractory installing method in the embodiment.
Figure 12:
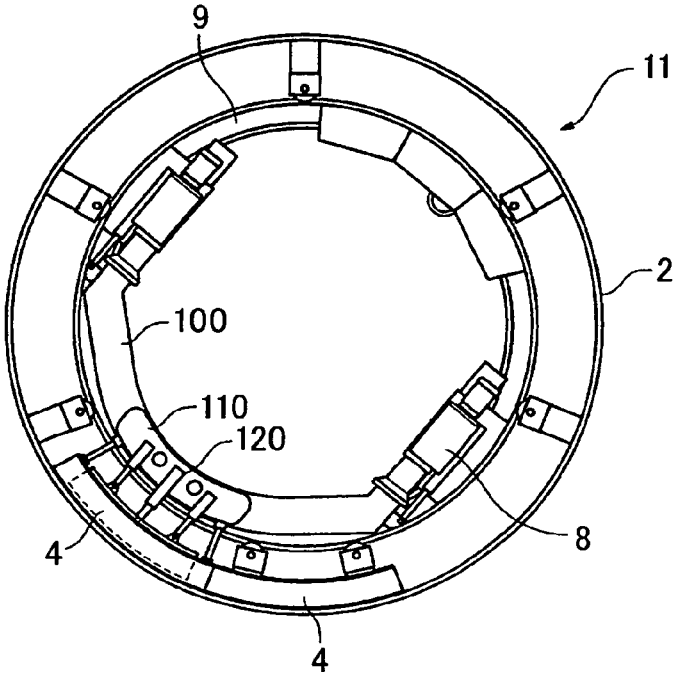
FIG. 12 is a view for schematically explaining a process of the refractory installing method in the embodiment.
Figure 13:
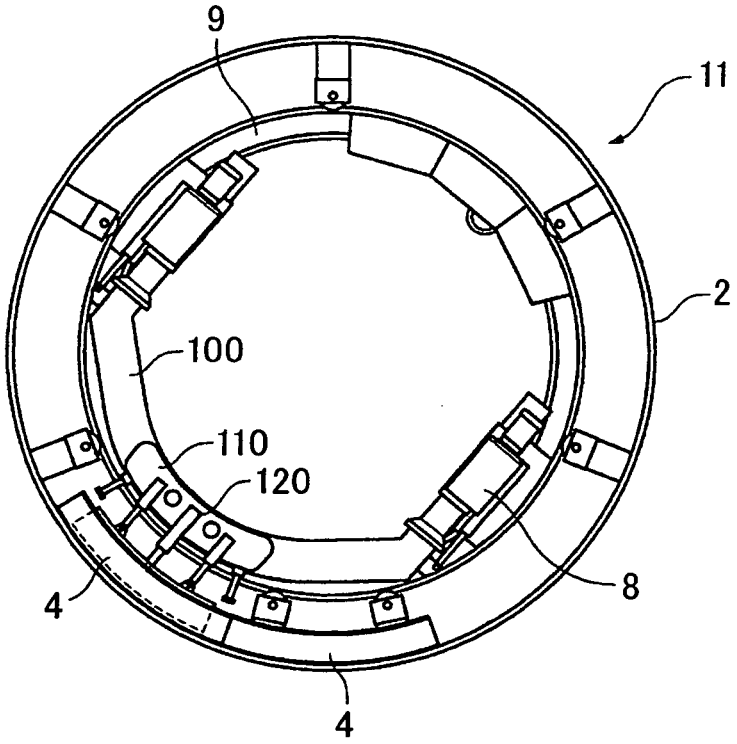
FIG. 13 is a view for schematically explaining a process of the refractory installing method in the embodiment.
Figure 14:
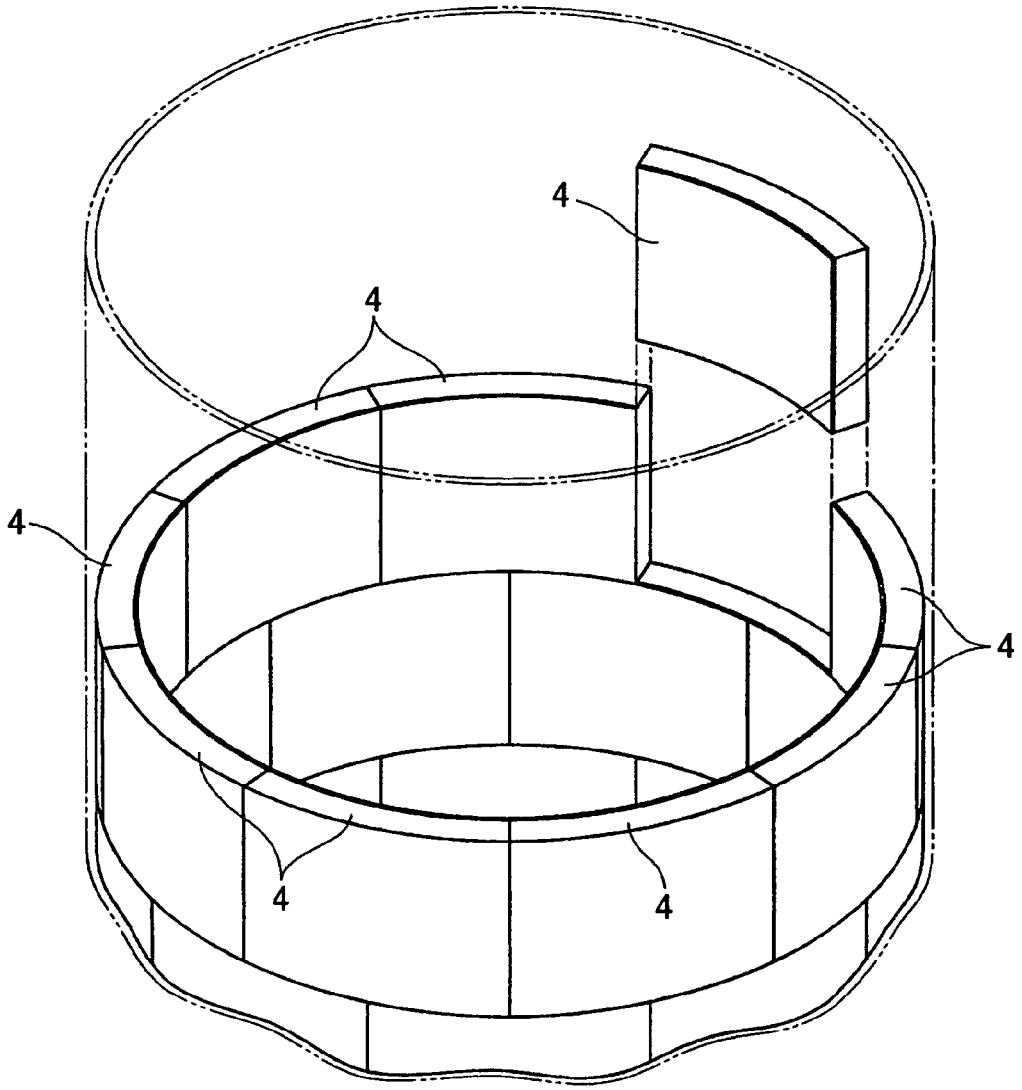
FIG. 14 is a view for schematically explaining a process of the refractory installing method in the embodiment.
Figure 15:
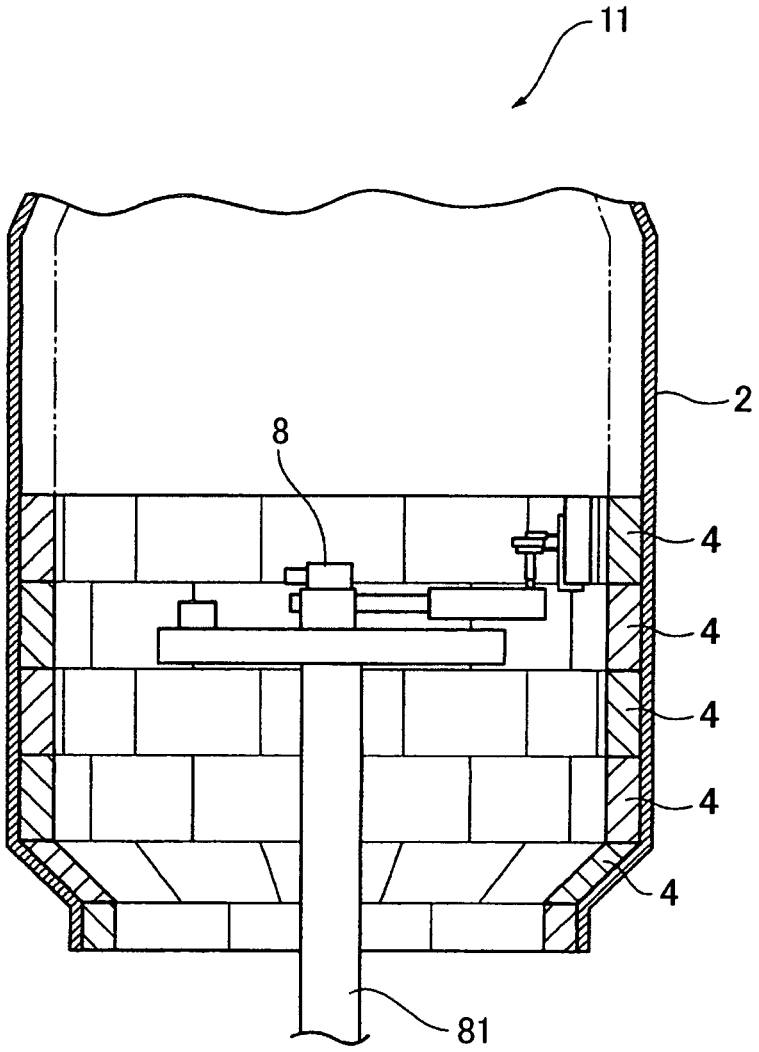
FIG. 15 is a view schematically indicating a refractory installing method as a modification of the embodiment.

Subsequently, as illustrated in FIG. 14, by handling the axially moving mechanism 7, the honeycomb block 4 to be installed is moved to the cylindrical axial direction (to the front side in the direction perpendicular to the paper) of the converter furnace 11. Then, as illustrated in FIG. 11, by handling the rotating mechanism 9, the honeycomb block 4 is rotated to a desired position. After rotating the honeycomb block 4, as illustrated in FIG. 12, by handling the radially moving mechanism 100, the honeycomb block 4 is moved to the lining position (installing position). At this time, by handling the rolling jack 122 (the reference number is omitted in FIGS. 9-13) of the refractory holding mechanism 120, the posture of the honeycomb block 4 is adjusted, thereby introducing the honeycomb block 4 to the proper position. After setting the honeycomb block 4, as illustrated in FIG. 15, the honeycomb block 4 is detached from the holding cylinder 123 of the refractory holding mechanism 120.

Then, at the time of installing each of the honeycomb blocks 4, a filling material is injected in a space between a cold-face end surface and the honeycomb blocks 4. With respect to the injection pump for injecting the filling material, it is desirable to use a double piston type pump which has a high pumping pressure, and the injection pump may be integrally attached to the refractory block lining device 8. Repeating this process, the honeycomb blocks 4 are subsequently installed in the circumferential direction of the converter furnace 11. However, with respect to the last honeycomb block 4, considering the shape of the honeycomb block 4, it is impossible to insert the last honeycomb block 4 by moving the honeycomb block 4 from the circumferential direction. Therefore, as illustrated in FIG. 14, the last honeycomb block 4 is inserted from the cylindrical axial direction of the converter furnace 11 (note that in the drawings, for the sake of simplifying the explanation, the shape of the honeycomb block 4 is depicted in the planar shape).

It is preferable that these honeycomb blocks 4 be installed with 9-10 blocks in a ring (one circumferential row) as one lining unit, for the sake of achieving the object of the invention to improve the lining efficiency and reduce the number of joint gaps. Note that in the above embodiment, the female screw is provided on the surface of the honeycomb block and the male screw is provided on the refractory block holding mechanism 8 in order to hold the honeycomb block 4 by screwing them together; however, instead of this configuration, a configuration in which a grip 72 as shown in FIG. 3 is provided on the honeycomb block 4 and a cylindrical grasping body or the like that grasps the grip 72 is provided on the refractory block holding mechanism 8 for holding the honeycomb block 4 may be employed.

(Modification of the Embodiment)

In the above-explained first embodiment, the refractory block lining device 8 installs the honeycomb blocks 4 in a state such that the converter furnace 11 is tilted to substantially 90° at the front furnace space; however, the present invention using the refractory block lining device 8 is not limited only to the above installing method.

That is, it is also possible to employ a installing method as illustrated in FIG. 15 in which the honeycomb blocks 4 are stacked from the bottom by elevating the refractory lining device 8 in the vertical direction in a state that the converter furnace 11 is vertically standing. In this installing method, it is preferable that the refractory block lining device 8 be set on the elevating mechanism 81.

EXAMPLE

As illustrated in FIG. 6, the honeycomb blocks 4 are installed by: fixing the converter furnace 1 with a capacity of 350 tons in a state of being tilted to 90°; subsequently placing the honeycomb blocks 4 with a rail by which a refractory lining device 8 used in the present invention can forwardly move to a lining wall side; subsequently installing the honeycomb blocks 4 having a large size from a furnace bottom side by using the refractory block lining device 8; and backwardly moving the refractory lining device 8 to a furnace front side while injecting a filling material from an opening portion formed in the honeycomb blocks 4 to a space between the honeycomb blocks 4 and the steel shell.

A steel outlet hole is promptly and accurately constructed by arranging refractory blocks in which a sleeve has been formed.

As a result, the amount of work for the furnace building was reduced to 1/10 when compared with a case of conveying conventional general bricks to the inside-furnace and manually installing the bricks in the furnace. In addition, the corrosion rate index was reduced by 15% and the service life of the lining was increased by 20%.

In this example, it was confirmed that the construction time and the amount of work for building the furnace were significantly reduced and therefore the lining efficiency was extremely high.

In addition, it was possible to use a large honeycomb block 4 with the weight of 420 kg/piece, which is significantly larger than the conventional refractory block with the weight of 35 kg/piece. This makes it possible to significantly reduce the number of joint gaps, thereby improving the corrosion rate index and the service life of the lining. Note that the corrosion rate index is a value obtained by dividing the size (amount) of corrosion by the practical heating count, and then indexing this value with respect to the conventional example as 100. In addition, the service life of the lining is the number of practical operations of the converter furnace 11 from a lining operation performed by installing honeycomb blocks 4 or conventional bricks inside the furnace 11 until when the next lining operation is needed.

Moreover, it was confirmed that when the lining operation was performed in a state such that the converter furnace 11 is vertically standing as illustrated in FIG. 15, a similar result to the above example was obtained.

INDUSTRIAL APPLICABILITY

According to the present invention, even if the operation is performed by an unskilled lining operator, it is possible to determine the position of the refractory block in the circumferential direction by arranging refractory blocks at predetermined intervals at each row and then fitting refractory blocks of a row in operation between refractory blocks in the row under the operating row. Accordingly, it is possible to significantly shorten the construction duration.

REFERENCE SIGNS LIST

1 furnace
11 converter furnace
2 steel shell
3 half-block
4 honeycomb block (refractory block)
44 coupling plate
45 refractory body
46 coupling piece
47 hole
48 bolt
49 pin
490 hook
5 powder refractory
6 paper material (thermal expansion absorbing member)
32, 42 inside end surface (hot-face end surface)
43 outside end surface (cold-face end surface)
70 honeycomb block arrangement jig
71, 77 iron plate (metallic plate)
72, 78 grip
74 adhesive
76 half-block arrangement jig
8 refractory block lining device
81 elevating mechanism
9 rotating mechanism
91 ring frame
92 supporting roller
93 rotating motor
94 counterweight
100 radially moving mechanism
101 hydraulic cylinder
102 supporting arm
110 axially moving mechanism
120 refractory block holding mechanism
121 center pin
122 rolling jack
123 holding cylinder
124 holding plate

The invention claimed is:

1. A refractory installing method for lining refractories with an inside surface of a steel shell of a cylindrical furnace, where a refractory includes hexagonal cone trapezoid refractory blocks and half-blocks that have a shape obtained by dividing the refractory blocks, the method comprising:

using a refractory block which includes a hot-face end surface which has a hexagonal shape and a cold-face end surface which has a hexagonal shape larger than the hot-face end surface, and the refractory blocks are formed such that two surfaces among the six surfaces present at a barrel portion surface are trapezoid shapes that expand from the hot-face end surface toward the cold-face end surface and the facing surfaces are parallel;

using half-blocks which include a block shape made by cutting the refractory blocks so that the hot-face end surface and the cold-face end surface are each equally divided into two trapezoids at surfaces that are parallel to the two trapezoid surfaces of the barrel portion surface;

including, in the refractory block, a block arrangement jig having a metallic plate that is provided on only the hot-face end surface of the refractory block and directly fixed to the hot-face end surface of the refractory block by both an adhesive and a bolt, and a metallic grip that is provided on a surface of the metallic plate and extends from a substantially center portion of the surface of the metallic plate to an inside in the radial direction of the furnace, the metallic grip being straight shaped;

arraying a plurality of the refractory blocks such that each position of the hot-face end surface is positioned along the radial direction of the furnace is aligned with a predetermined reference position;

stacking the plurality of refractory blocks along the circumferential direction of the steel shell inner surface and the trapezoid face of the barrel portion surface faces a direction perpendicular to the axial direction of the cylindrical body of a furnace in a honeycomb manner; and arraying, at the bottom portion of the steel shell of the cylindrical furnace when stacking, a plurality of half-blocks at predetermined intervals along a circumferential direction such that the end surface shape form a trapezoid in which the lower base is longer than the upper base, disposing the refractory blocks so as to fit between half-blocks, stacking the refractory blocks in a honeycomb manner, and at the top of the steel shell of the cylindrical furnace, arraying in plurality half-blocks so as to form a trapezoid in which the end surface shape is longer at the upper base than the lower base, wherein before the arraying and the stacking, the metallic plate of the block arrangement jig is directly fixed to the hot-face end surface of the refractory block, the block arrangement jig and the refractory block are fixed together, and the whole cold-face end surface of the refractory block is exposed, and in the arraying and the stacking, the refractory blocks to which the block arrangement jig is fixed in a cantilever manner are lifted and installed by grasping the metallic grip.

* * * * *